US005689773A

United States Patent [19]

Ha

[11] Patent Number: 5,689,773

[45] Date of Patent: Nov. 18, 1997

[54] EXCHANGEABLE TONER CARTRIDGE FOR AN IMAGE FORMING APPARATUS

[75] Inventor: Yong Ung Ha, Seoul, Rep. of Korea

[73] Assignee: Samsung Electronics Co., Ltd., Kyungki-do, Rep. of Korea

[21] Appl. No.: 612,824

[22] Filed: Mar. 11, 1996

[30] Foreign Application Priority Data

Mar. 9, 1995 [KR] Rep. of Korea ..... 95-4021

[51] Int. Cl.[6] ..... G03G 15/08

[52] U.S. Cl. ..... 399/106; 399/262

[58] Field of Search ..... 355/260, 200, 355/210, 215, 245; 118/653; 399/89, 102, 103, 106, 110, 111, 119, 252, 258, 262

[56] References Cited

U.S. PATENT DOCUMENTS 4,895,104 1/1990 Yoshino et al. .
5,018,560 5/1991 Tsukamoto .
5,294,963 3/1994 Nakano et al. .
5,383,502 1/1995 Fisk et al. .
5,475,479 12/1995 Hatakeyama et al. .
5,513,679 5/1996 Yamada .

*Primary Examiner*—Sandra L. Brase
*Attorney, Agent, or Firm*—Banner & Witcoff, Ltd.

[57] ABSTRACT

An improved exchangeable toner cartridge installed on a developing unit of an image forming apparatus includes a first seal detachably attached to the bottom thereof for closing off a toner supplying opening formed at the bottom, and a second sealing means disposed to the outside of the first seal for preventing the leakage or spread of toner due to the poor attachment of the first seal. Alteratively, the second seal is disposed between the bottom of the toner cartridge and the first seal.

6 Claims, 3 Drawing Sheets

EXCHANGEABLE TONER CARTRIDGE FOR AN IMAGE FORMING APPARATUS

BACKGROUND OF THE INVENTION

The present invention relates to an exchangeable toner cartridge for an image forming apparatus and more particularly to an improvement in the sealing structure for removably closing a toner supply opening of the toner cartridge to prevent the leakage of toner therefrom.

Typically, an image forming apparatus such as a printer includes a developing unit for applying toner supplied from a toner cartridge onto a photo conductor to develop a latent image. The developed image is then transferred and fixed onto a sheet of paper.

In conventional apparatus, the toner cartridge is installed on a hopper of a toner tank of the developing unit. A seal is removably provided on the bottom of the toner cartridge for closing a toner supplying opening. Generally, the toner cartridge should be exchanged for a new one after about 1,500 pages are printed by use of the toner cartridge.

FIG. 1*a* shows a conventional toner cartridge 10' mounted on a toner tank 20' of a developing unit and FIGS. 1*b* and 1*c* show a conventional sealing structure and a sealing member removing process for supplying toner T' from the toner cartridge 10' of the toner tank 20'.

The toner cartridge 10' has a flange 11' upwardly extending from the lower end of each side thereof. Two resilient segments 12', each having a protrusion 13', are formed on flange 11'. The toner tank 20' has a hopper 27' through which toner can be introduced into the toner tank 20' from the toner cartridge 10'. The hopper 27' has upstanding segments 21', each having a hole 22' formed to engage corresponding protrusion 13' of resilient segment 12' of the toner cartridge 10'. A pair of hinges (not shown) provided on the rear side of the toner cartridge are engaged with the corresponding retainers 25' and 26'. Such a structure for mounting the toner cartridge 10' on the toner tank 20' is well known. The toner cartridge 10' has an opening (not shown) from which toner is supplied to the toner tank 20'. The opening is formed at the bottom of the toner cartridge 10' and is closed off by a sealing member 30'.

The sealing member 30' has the sealing portion 31' that is detachably attached to the periphery of the opening, a folded portion 32' extended therefrom and folded under sealing portion 31', and a tab 33' which is folded over an end of toner cartridge 10' and attached to the top surface of the toner cartridge.

After mounting the toner cartridge on the toner tank 20', a user can remove the sealing member 30' by detaching tab 33' in the direction of arrow A' and drawing tab 33' in the direction of arrow B', thereby exposing the opening and filling the toner tank 20' with toner.

However, there is a problem that toner is spilled and spread within the image forming apparatus during changing of the toner cartridge because of excess movement during detachment of attached potion 31' or the leakage of toner due to poor sealing attachment.

SUMMARY OF THE INVENTION

It is an object of the present invention to provide an improved exchangeable toner cartridge for an image toning apparatus with an improved sealing structure which prevents the toner from spilling or spreading inside the image forming apparatus.

According to the invention, the improved toner cartridge comprises flanges upwardly extending from a lower edge of each side thereof to be mounted on a hopper of a developing unit, locking means provided on the flanges for positioning the toner cartridge on the hopper, first sealing means detachably attached to the periphery of a toner supply opening formed at the bottom of the toner cartridge and a second sealing means provided on the outside of the first sealing means for preventing toner leakage from the opening.

Alternatively, the second sealing means may be provided between the bottom of the toner cartridge and the first sealing means.

These and other features and advantages of the invention may be more completely understood from the following detailed description of the preferred embodiment of the invention with reference to the accompanying drawings.

DETAILED DESCRIPTION OF THE PREFERRED EMBODIMENT

Figure 2:
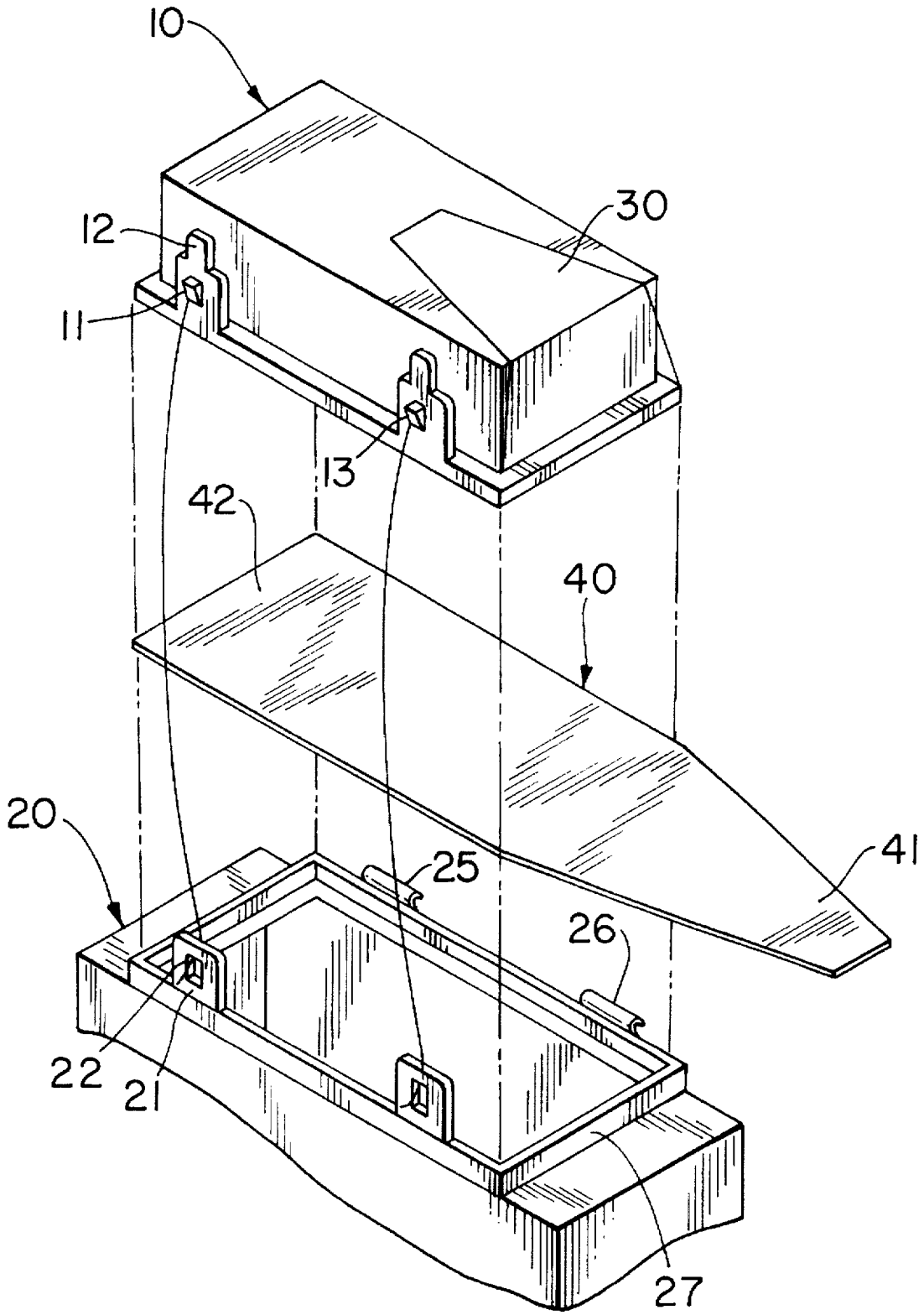
FIG. 2 is an exploded perspective view similar to FIG. 1*a*, illustrating a toner cartridge having a first sealing member and a second sealing toner member in accordance with the present mention.

FIG. 2 shows the structure for mounting a toner cartridge 10 on a hopper 27 of the toner tank 20 of a developing unit partially shown in FIG. 2. The toner cartridge 10 has a first sealing member 30 adhered to the periphery of a toner supplying opening formed at the bottom of toner cartridge 10 for closing the opening, and a second sealing member 40 provided to the outside of first sealing member 30. First sealing member 30 is preferably attached to toner cartridge 10 by heat sealing.

Figure 1A:
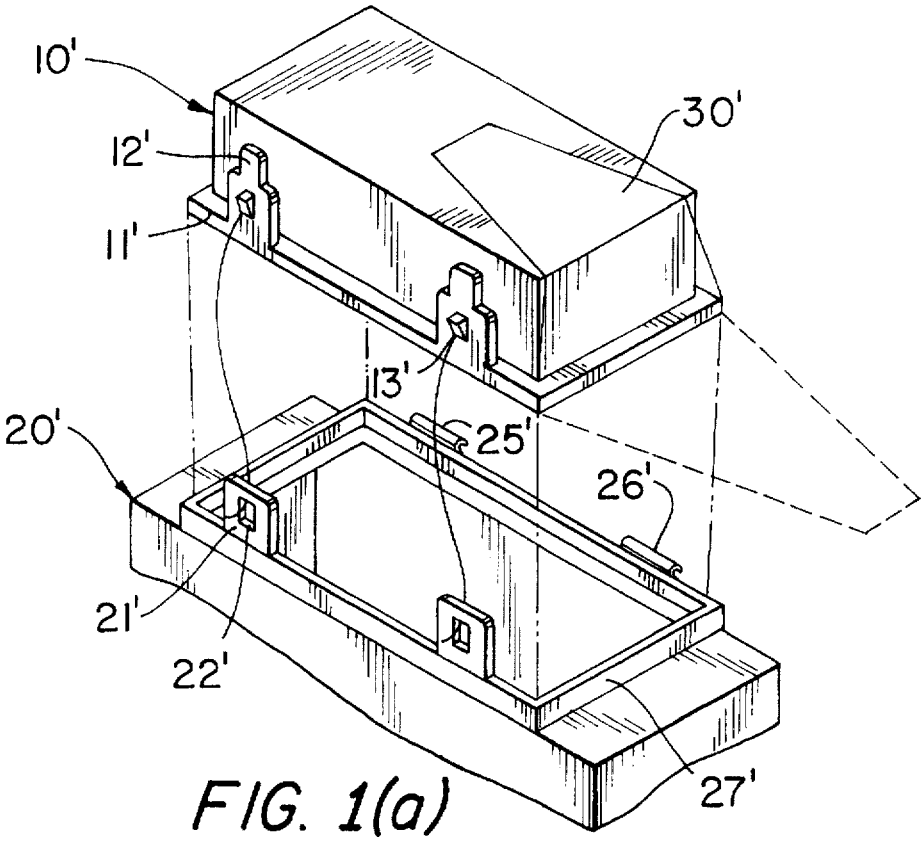
FIG. 1(a) PRIOR ART
FIG. 1*a* is an exploded perspective view of the conventional mounting structure of a toner cartridge on a developing unit which is partially depicted.

The mounting structure of the toner cartridge 10 on hopper 27 is similar to the structure in Fig. 1*a*. The reference numerals are the same, but not primed, as those given to corresponding portions and members in Fig. 1*a*, and the descriptions thereof are omitted for the conciseness of the specification.

Figure 3A:
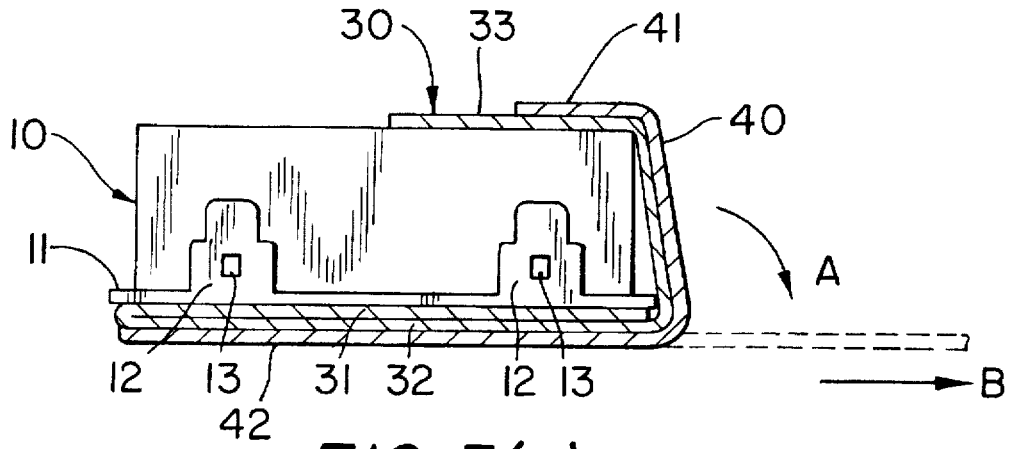
FIG. 3*a* is a side view of the toner cartridge of FIG. 2 having the first and second sealing members in accordance with the present invention shown assembled.
Figure 3B:
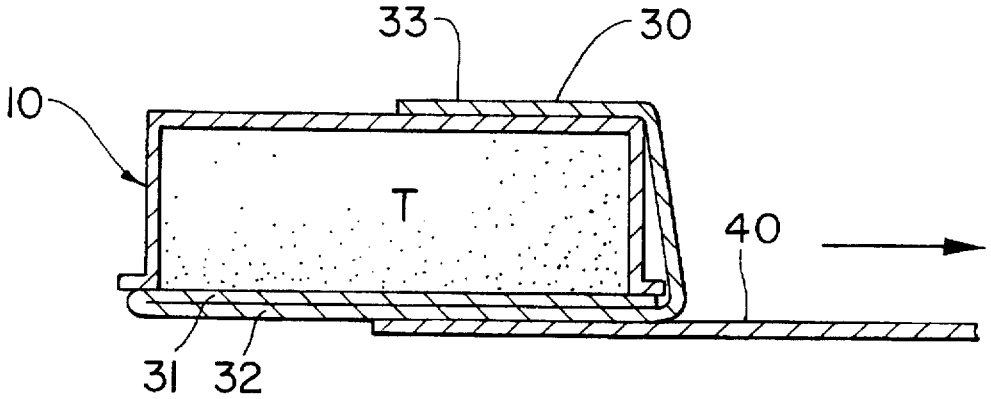
FIG. 3*b* and 3*c* are sectional elevation views showing the removal operation of the first and second sealing members after installing a new toner cartridge on a conventional developing unit.
Figure 3C:
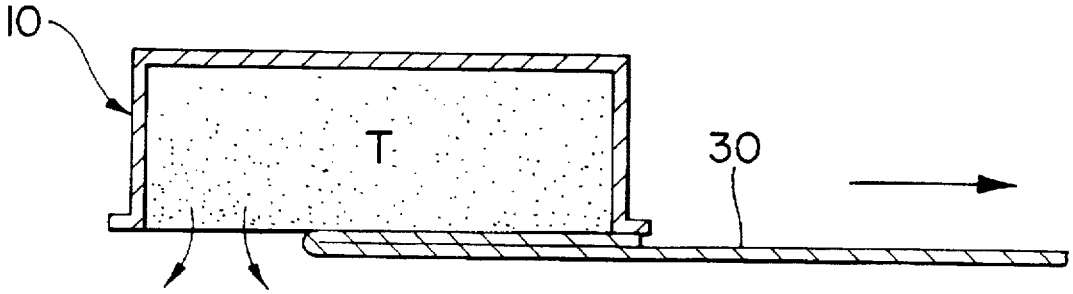

According to the present invention, as shown in FIG. 3, second sealing member 40 has a sealing portion 42 disposed to the outside of first sealing member 30 and a tab potion 41 adhered to a tab of first sealing member 30 with an adhesive. Preferably, the width of the sealing portion 42 is broader than that of first sealing member 30.

After mounting toner cartridge 10 on hopper 27, a user detaches tab portion 41 from the tab of first sealing member 30 in the direction of arrow A, and removes second sealing member 40 by drawing tab 41 thereof in the direction of arrow B.

Figure 1B:
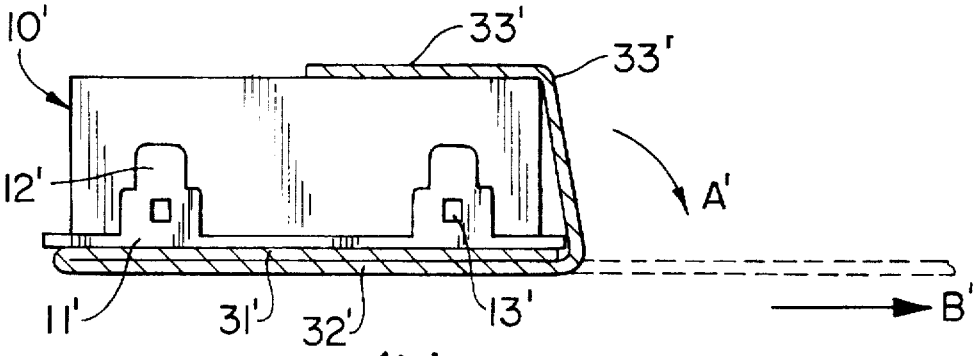
FIG. 1(b) PRIOR ART
FIG. 1*b* is a side view of the toner cartridge in FIG. 1*a* shown assembled.
Figure 1C:
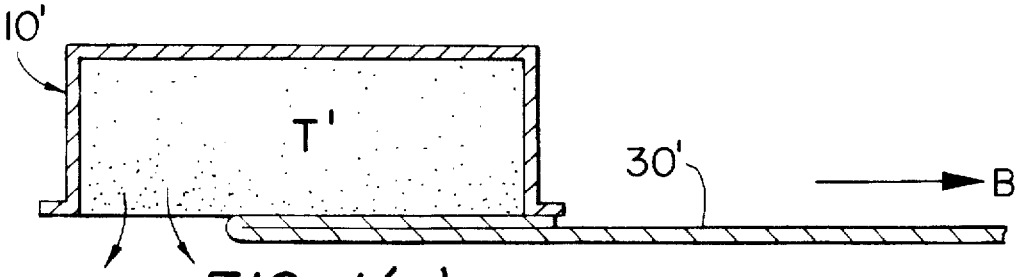
FIG. 1(c) PRIOR ART
FIG. 1*c* is a sectional elevation view of the toner cartridge of FIG. 1*a* showing the removing operation of the sealing member.

Secondly, first sealing member 30 is removed as described with respect to sealing member 30' of FIGS. 1*b* and 1*c* to supply toner to a toner tank 20 of the developing unit. The order of removal of first and second sealing members 30 and 40 can of course be reversed.

Preferably, second sealing member 40 is made of polyethylene coated polypropylene and has a thickness in the range of 0.05 mm–0.15 mm.

Alternatively, second sealing member 40 may be provided on the bottom of toner cartridge 10 to close the opening thereof and then first sealing member 30 is attached at the periphery of the opening formed at the bottom of toner cartridge 10. Preferably, in this case the width of sealing portion 42 is narrower than that of first sealing member 30.

Second sealing member 40 according to the invention prevents the leakage or spread of toner into the image forming apparatus due to poor attachment or excess movement during detachment of first sealing member 30 when a new toner cartridge is installed on hopper 27 of toner tank 20.

Obviously, numerous modifications and variations of the present invention are possible in light of the above teachings. It is therefore to be understood that within the scope or the appended claims, the invention may be practiced otherwise than as specifically described herein.

What is claimed is:

1. An exchangeable toner cartridge installed on a developing unit having a flange upwardly extended from a lower edge of each side thereof, said toner cartridge comprising discrete first and second sealing means, said first sealing means removably attached to the bottom of said toner cartridge for selectively closing off a toner supplying opening formed at the bottom; and second sealing means removably disposed on said first sealing means for preventing leakage or spread of toner due to poor attachment or excess movement during removal of said first sealing means.

2. The toner cartridge of claim 1 wherein said second sealing means includes a sealing portion and a tab portion, said tab portion being adhered to a corresponding tab of the first sealing means.

3. The toner cartridge of claim 1, wherein said second sealing means is made of synthetic resin and has a thickness in the range of 0.05 mm–0.15 mm.

4. A toner cartridge exchangeable installed on a developing unit having a flange upwardly extended from a lower edge of each side thereof, said toner cartridge comprising discrete first and second sealing means, said first sealing means removably attached to the bottom of said toner cartridge for selectively closing off a toner supplying opening formed at the bottom; and second sealing means removably disposed between the bottom of said toner cartridge and said first sealing means.

5. The toner cartridge of claim 4, wherein said second sealing means is made of synthetic resin and has a thickness in the range of 0.05 mm–0.15 mm.

6. A toner cartridge having a toner supply opening defining an opening periphery, said cartridge adapted to be installed on a developing unit for supplying toner through the opening, the opening being closed off by a reinforced seal structure, said seal structure comprising;

first sealing means adhesively attached to the periphery of the opening having a tab portion for facilitating removal of said first sealing means; and second sealing means detachably attached to said first sealing means to reinforce said seal structure to prevent leakage of toner due to inadequate attachment; said second sealing means having a tab portion for facilitating removal thereof.

* * * * *